US005596856A

United States Patent [19]

Lebon

[11] Patent Number: 5,596,856

[45] Date of Patent: Jan. 28, 1997

[54] METAL GIRDER ELEMENT FOR CONSTRUCTING A HYBRID ELONGATE STRUCTURE HAVING A BOX-TYPE CROSS SECTION, METHOD FOR EMPLOYING THIS ELEMENT, AND ELONGATE STRUCTURE CONSTRUCTED BY IMPLEMENTING THIS METHOD

[75] Inventor: Jean-Daniel Lebon, St Germain en Laye, France

[73] Assignee: Campenon Bernard SGE, Rueil-Malmaison, France

[21] Appl. No.: 285,808

[22] Filed: Aug. 3, 1994

[30] Foreign Application Priority Data

Aug. 4, 1993 [FR] France ..... 93 09625

[51] Int. Cl.[6] ..... E04B 1/16

[52] U.S. Cl. ..... 52/334; 52/650.1; 52/731.2

[58] Field of Search ..... 52/650.1, 671, 52/731.2, 731.3, 731.4, 731.5, 731.6, 334, 724, 745.19; 14/3, 4

[56] References Cited

U.S. PATENT DOCUMENTS

| | | | |
|---|---|---|---|
| 3,257,764 | 6/1966 | Cripe | 52/724 X |
| 3,401,497 | 9/1968 | Gregory | 52/334 X |
| 4,129,917 | 12/1978 | Sivachenko et al. | 52/731.2 X |
| 4,912,794 | 4/1990 | Thivans | 14/3 |
| 4,945,705 | 8/1990 | Rump et al. | 52/731.2 |
| 5,134,824 | 8/1992 | Guazzo | 52/334 |
| 5,338,499 | 8/1994 | Ryynanen | 52/334 X |

*Primary Examiner*—Creighton Smith
*Attorney, Agent, or Firm*—Young & Thompson

[57] ABSTRACT

The metal girder element (5, 6) possesses a section of web (7, 10) fixed along its longitudinal edges respectively to a section of upper flange (8) and to a section of lower flange (9). Each section of flange (8, 9) of this element (1, 2) possesses, on its outer surface opposite the web (7, 10), connection elements (12, 13), the number, dimensions and positions of which are predetermined in such a way that said connection elements (12, 13) are capable of supporting the driving stresses of said section of flange (8, 9) via the concrete during the designed deformations of the structure thus formed.

5 Claims, 5 Drawing Sheets

METAL GIRDER ELEMENT FOR CONSTRUCTING A HYBRID ELONGATE STRUCTURE HAVING A BOX-TYPE CROSS SECTION, METHOD FOR EMPLOYING THIS ELEMENT, AND ELONGATE STRUCTURE CONSTRUCTED BY IMPLEMENTING THIS METHOD

The present invention relates to a metal girder element possessing a section of web fixed along its longitudinal edges respectively to a section of upper flange and to a section of lower flange, said metal girder element being suitable for being used to construct, by means of successive elements, a hybrid elongate structure of box-type cross section possessing a concrete upper slab and a concrete lower slab connected to each other over their entire length by at least two metal girders, each of the metal girders being constituted by a continuous web fixed along its longitudinal edges respectively to means forming an upper flange and to means forming a lower flange, each flange being discontinuous and possessing connection elements suitable for being embedded in the concrete in order to connect the flange to the concrete of the corresponding hollow block.

The present invention also relates to a method for employing the aforementioned metal girder element so as to construct, by means of successive structural elements joined one after the other, a hybrid elongate structure of box-type cross section, as well as a hybrid elongate structure constructed by implementing this method.

Numerous examples of metal girder elements, methods and hybrid elongate structures of the aforementioned types are known.

In the present invention, hybrid elongate structures will be described which are constituted by highway or railroad bridge girders essentially extending along a main direction. It is well understood that the present invention also applies to hybrid elongate structures extending along two perpendicular main directions, for example to slabs possessing a plurality of juxtaposed girders of the aforementioned type, or to two parallel slabs connected to each other by a plurality of parallel metal girders.

Bridge girders are thus known which have a hybrid box-type structure possessing two concrete slabs connected by metal girders, the web of which consists of flat metal sheets fixed end to end.

A box-type bridge girder is also known, from EP-A-0, 283,383, which possesses two slabs joined together by two metal girders, the web of which consists of corrugated metal sheets fixed end to end.

In both of these types of structure, the flanges and the webs of the girder elements are connected respectively to each other, for example by welding before casting the concrete of the hollow blocks or corresponding hollow-block elements, and the operations of joining the metal girders and the operations of fabricating and of joining the concrete hollow blocks are carried out one after the other. The rhythm of the work of the specialized crews, respectively in the welding work and in the concrete work, is therefore irregular and the construction time of the structure in question is long.

The object of the present invention is to remedy the drawbacks of the known metal girder elements, known methods and known hybrid elongate structures, and to propose a novel metal girder element and a novel method, of the aforementioned types, making it possible to reduce the cost and the construction time of a hybrid elongate structure, as well as a hybrid elongate structure produced by implementing this method.

According to the invention, the metal girder element of the aforementioned type is one in which each section of flange of said element possesses, on its outer surface opposite the web, connection elements, the number, dimensions and positions of which are predetermined in such a way that said connection elements are capable of withstanding the driving stresses of said section of flange via the concrete during designed deformations of said structure.

This novel structure is to be compared with the known conventional structure in which each flange is continuous from one end of the structure to the other and is connected to the corresponding concrete slab, essentially at its ends, by connection elements. Significant stresses are therefore transmitted by the slab to the flange and vice versa, so that the flange has to be dimensioned so as to withstand all these stresses, and has to have a suitable thickness often equal to several centimeters: such a thickness furthermore poses serious problems for joining metal sheets end to end, for example by welding.

On the contrary, according to the invention, the stresses transmitted by the section of slab to the section of flange are those generated at this single section. They are therefore limited and require only a limited number of connection elements. Likewise, the thickness of the section of flange may be reduced since the section of flange supports only limited stresses. Finally, since the driving stresses of the flange are entirely supported at the corresponding elongate structural element, two adjacent elongate structural elements may be employed and connected to each other without having to connect the corresponding sections of flange.

According to a preferred version of the invention, the length of each of the sections of flange is substantially less than the corresponding length of said metal girder element.

According to a second aspect of the invention, the method of the aforementioned type, in which, on the one hand, the sections of slabs and, on the other hand, the sections of webs of said structural elements are connected to each other, is one in which the sections of flange are left separated from each other, and in which predetermined linkage means are used to connect the sections of slabs to each other, said linkage means being suitable for transmitting, from one structural element to an adjacent structural element, all the longitudinal stresses generated within the elongate structure during its use.

Thus savings are made in the necessary time and cost for welding the sections of flanges. This is particularly beneficial when it is desired to limit the duration of a construction site as far as possible.

Furthermore, since the longitudinal stresses are transmitted from one structural element to an adjacent structural element by the slabs, it thus becomes possible to carry out the operation of linking the sections of web, for example by welding, independently of the operation of fabricating and linking the slabs, thereby enabling a significant further time saving to be made: the welding of the webs of a structural element may thus be carried out after having fabricated the slabs of this element and having connected them to the slabs of the preceding element, and therefore during what would otherwise be lost time during the preparation and fabrication of the slabs of the next structural element.

According to a third aspect of the invention, the hybrid elongate structure of the aforementioned type is one which is constructed by implementing the method according to the invention.

Other features and advantages of the invention will appear in the detailed description hereinbelow.

In the appended drawings, given solely by way of non-limiting examples:

Figure 1:
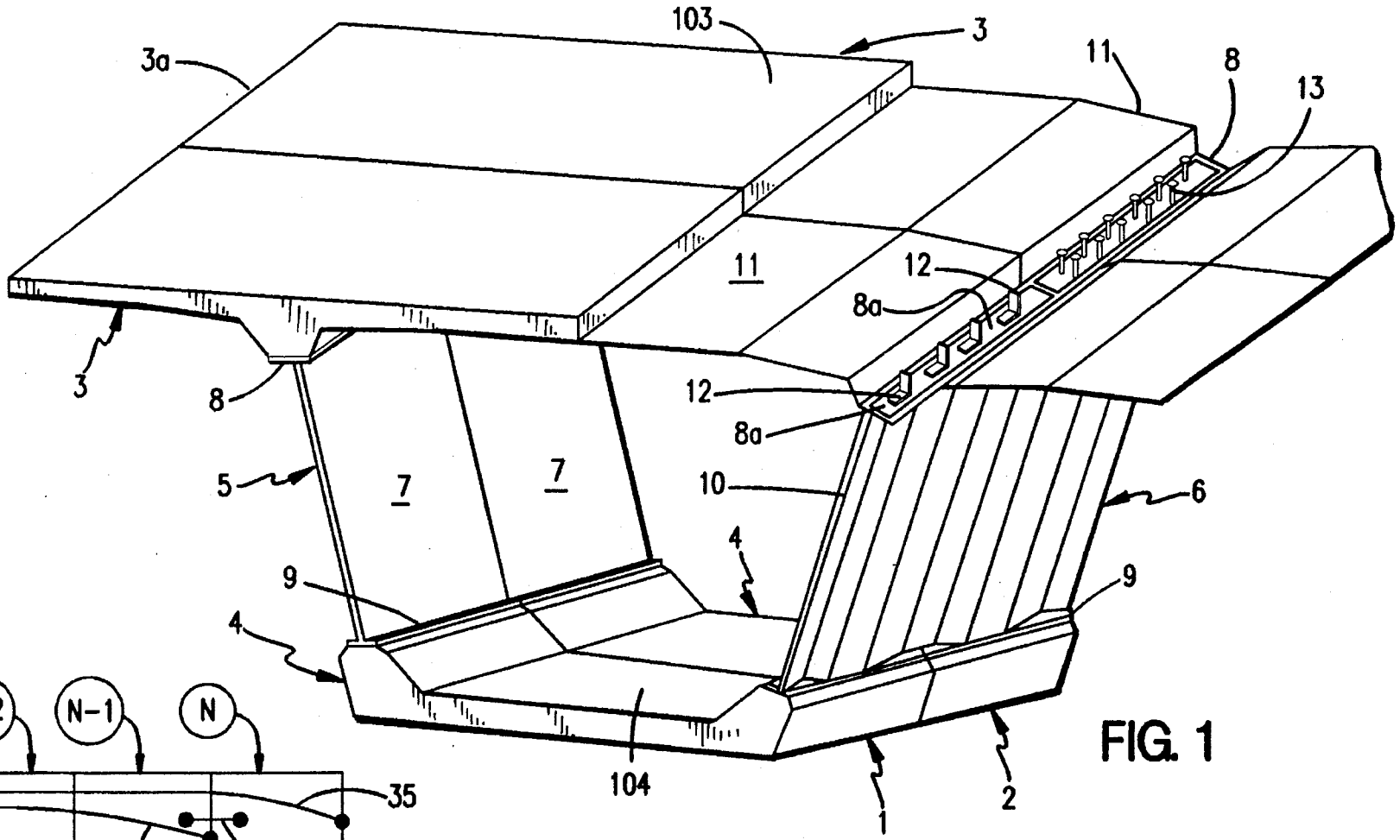
FIG. 1 is a fragmentary perspective view, of a hybrid structural element of box-type cross section in accordance with an embodiment of the invention.

In the embodiment depicted in FIG. 1, two adjoined elements 1, 2 of a hybrid elongate structure of box-type cross section have been depicted; these elements are elements of a highway or railroad bridge girder.

It is known that such a girder, which may be constructed by joining successive elements such as the hybrid structural elements 1 and 2, possesses a concrete upper slab 103 and a concrete lower slab 104 connected to each other over their entire length by at least two continuous metal girders. Each of the metal girders is constituted by a continuous web fixed along its longitudinal edges respectively to means forming an upper flange and to means forming a lower flange. Each flange possesses connection elements suitale for being embedded in the concrete in order to connect the flange to the concrete of the corresponding slab.

Each structural element 1, 2 thus possesses a section of upper slab 3 and a section of lower slab 4, both made of concrete and connected in the longitudinal direction by two metal girder elements 5, 6.

The metal girder element 5, located on the left in the figure, possesses a section of web 7 which is a flat metal sheet, fixed along its longitudinal edges respectively to a section of upper flange 8 and to a section of lower flange 9.

The metal girder element 6, located on the right in the figure, possesses a section of web 10 which is a corrugated metal sheet, and two sections of upper and lower flanges which are, for example, identical to the sections of flange 8 and 9 of the metal girder element 6, but which may, of course, be different from these. This corrugated metal sheet is, for example, of the type described in EP-A-0,283,383 in the name of the applicant company.

Conventionally, the section of upper slab extends, largely laterally, at 3*a*, beyond the metal girder elements 5, 6 in order to constitute the bed for the highway or for the rail track carried by the corresponding bridge.

In the left half-view, the concrete of the upper slab 3 has been cast and is depicted.

In the right half-view, the concrete of this upper slab has not yet been cast, and the shuttering prepared for receiving this concrete on either side of the corresponding section of upper flange 8 has been shown diagrammatically at 11.

According to the invention, each section of flange 8, 9 of the metal girder element 1, 2 possesses, on its outer surface 8*a*, 9*a*, opposite the web 7, 10, connection elements 12, 13, the number, dimensions and positions of which are predetermined in such a way that said connection elements 12, 13 are capable of supporting the driving stresses of said section of flange 8, 9, via the concrete, during designed deformations of the bridge girder once the latter is constructed and in service (or during strength tests).

Connection elements 12 have been depicted on the section of upper flange 8 of the element 1, these connection elements 12 being angle sections welded to the outer surface 8*a* of this flange 8 along the edges of one leg of the angle.

Connection elements 13 have been depicted on the flange 8 of the element 2, these connection elements 13 being headed studs welded by means of their end opposite the head to the outer surface 8*a* of the flange 8.

These connection elements 12, 13 are known per se and it has not been necessary to describe them in detail here: they may be joined together and to any other type of known connection elements on the same section of flange 8.

The same connection elements 12, 13 are fixed, for example by welding, to the outer face of each lower section of flange 9.

As depicted in FIGS. 2 to 5, the length of each of the sections of flange 8, 9 is substantially less than the corresponding length of the metal girder element 1, 2, which can be depicted by the length of the section of adjacent concrete slab 3, 4.

Figure 2:
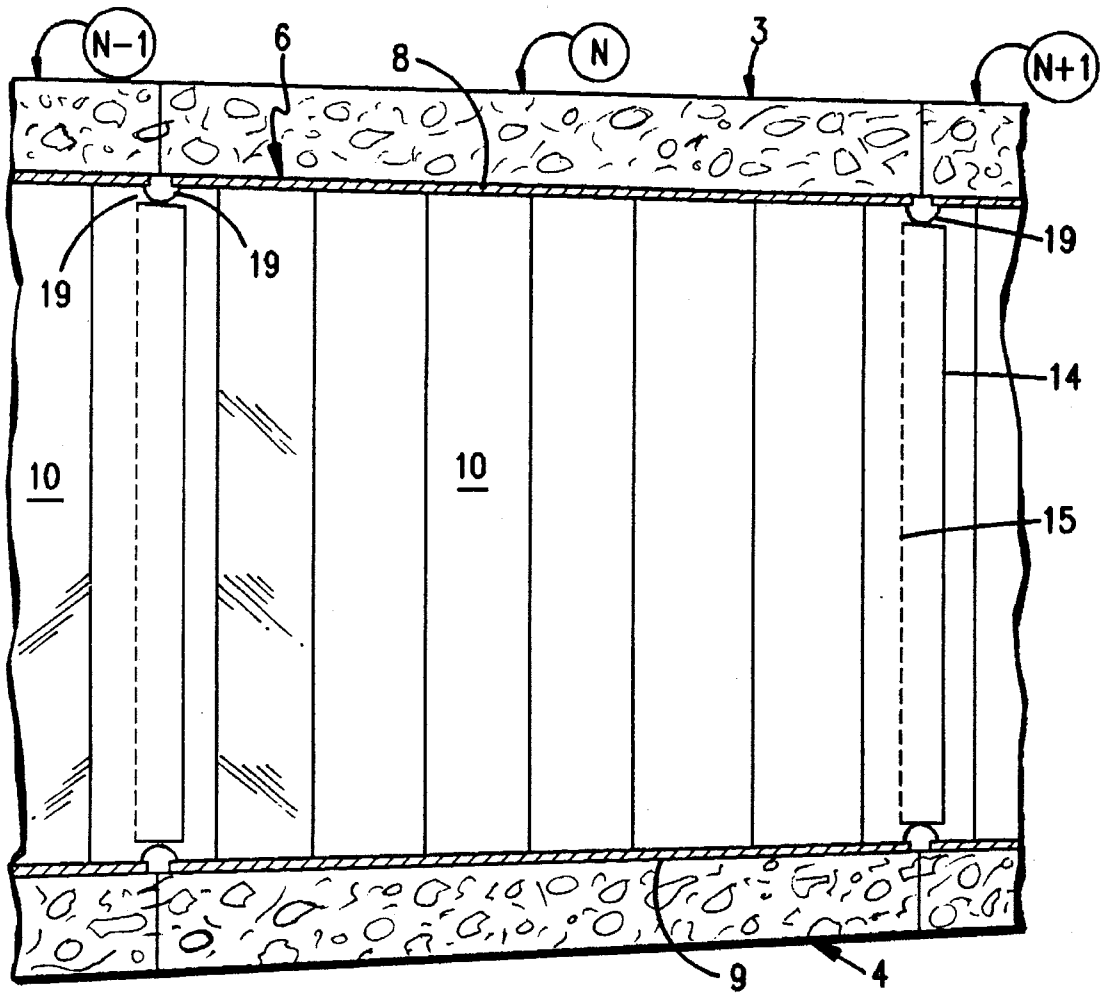
FIG. 2 is a partial sectional elevation view of the stuctural element of FIG. 1, showing a metal girder element and the two corresponding sections of slab.
Figure 4:
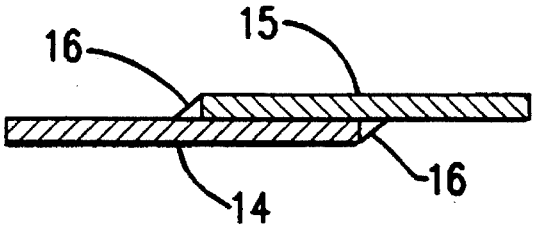
FIG. 4 is a sectional view along IV—IV of FIG. 3, depicting a method of joining two sections of webs.

In fact, it is recommended to arrange that the ends 14, 15 facing two sections of webs 7, 10, to be connected to each other, overlap each other in order to permit a lap weld as depicted in FIGS. 2, 4, a weld bead 16 being produced along each edge of each web.

Figure 5:
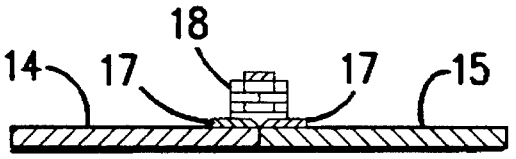
FIG. 5 is a view similar to FIG. 4 depicting a variant of the method of joining two sections of webs.

Another solution shown diagrammatically in FIG. 5 consists in welding an angle 17 along each web end 14, 15 and joining up the contiguous legs of two angles 17 by a suitable number of bolts 18.

Figure 3:
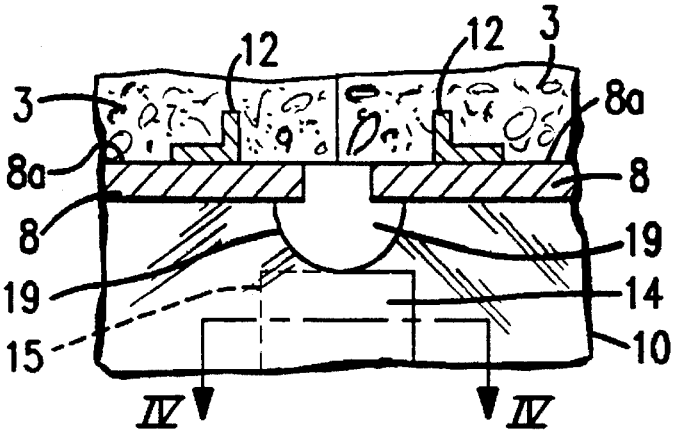
FIG. 3 is an enlarged view of a detail of FIG. 2.

In the embodiment of FIGS. 2 and 3, the section of upper flange 8 does not overlap the facing face of the corresponding concrete slab 3 right up to the end of said slab. On the contrary, the corresponding end 14, 15 of the web 10 goes beyond the end of the slab 3 in order to overlap the end 15, 14 of the section of adjacent web. In order to facilitate the construction of the bridge girder elements and the linking of the webs of two adjacent elements, for example by welding each side of the web, the end 14, 15 of the web may be connected to the flange 8, 9 by a concave indentation 19 which leaves the end of the flange 8, 9 free.

All the above applies equally well to sections of lower flange 9 as to the sections of upper flange 8 and to the sections of corrugated web 10 as to the sections of flat web 7.

The bridge girder elements 1, 2 are usually prestressed by tension members tensioned both in the longitudinal direction and in the transverse direction of the bridge girder (these tension members not being depicted). However, the present invention also applies to non-prestressed girders or structures.

Likewise, the bridge girder elements may be alternatively prefabricated and joined to each other in a known manner, or alternatively joined together and fabricated in situ, the concrete of the sections of slab 3, 4 being cast in situ, and this being equally well on the ground or on a support as overhanging, in a cantilevered fashion.

In a known manner, in the method for constructing a hybrid elongate structure of box-type cross section by means of successive structural elements joined one after the other, the sections of slabs on the one hand and the sections of webs of said structural elements on the other hand are connected to each other.

According to the invention, the method for employing the metal girder element described hereinabove for constructing such a hybrid elongate structure is one in which the sections of flange 8, 9 are left separated from each other, and in which predetermined linkage means are used to connect the sections of slabs 3, 4 to each other, these linkage means being suitable for transmitting, from one structural element to an adjacent structural element, all the longitudinal stresses generated within the elongate structure during its use.

These linkage means are any known elements: they may be passive elements, such as reinforcing bars with a smooth surface or with high bonding, or any other known elements for this function.

These linkage means may also be active means, such as tensioned members for prestressing the concrete, which may equally well be, in a known manner, inserted into tubes embedded in the concrete and/or arranged outside the concrete masses.

It is also possible to use both passive linkage means and active linkage means.

Figure 10:
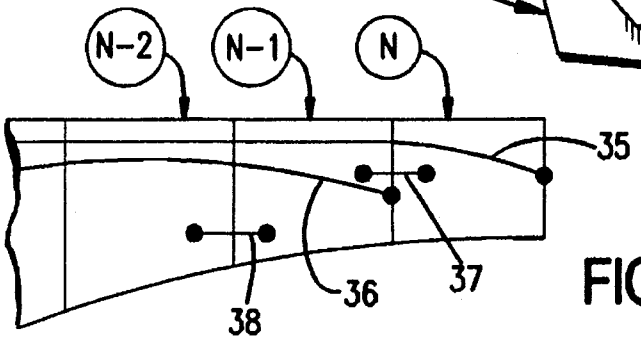
FIG. 10 is an elevation diagram illustrating the means of linkage between adjacent hybrid stuctural elements.

FIG. 10 thus shows diagrammatically the end of an overhanging hybrid structure consisting of three structural elements denoted by (N–2), (N–1) and (N). The element (N) is fixed to the element (N–1) by tensioned prestressing members shown diagrammatically at 35. Likewise, the element (N–1) is fixed to the element (N–2) by tensioned prestressing members shown diagrammatically at 36.

Passive linkage means 37, 38 are also installed respectively between the element (N) and the element (N–1) and between the latter and the element (N–2).

Since all the longitudinal stresses are transmitted to the sections of slab 3, 4, it is unnecessary to weld or connect the sections of flange 8, 9 to each other. It is also possible to shift in time the operations of welding or joining the sections of web 7, 10 from the operations of fabricating and joining the corresponding concrete sections of slabs.

Thus, for the construction of a structure by joining prefabricated hybrid structural elements, one after the other, the sections of upper and lower slabs of an element (N) are firstly connected to the sections of upper 3 and lower 4 slabs of the preceding element (N–1), and then the sections of webs 7, 10 of the element (N) are connected to those of the element (N–1).

Likewise, for the constuction of a structure by means of successive overhanging structural elements joined together and constructed in situ, the procedure is as follows:

the concrete of the lower 4 and upper 3 slabs of an element (N) is cast;

the lower 4 and upper 3 slabs of the element (N) are respectively connected to the corresponding slabs of the element (N–1);

the sections of webs 10 of the element (N) may start to be connected to those of the element (N–1);

the shuttering and the reinforcement for the lower slab of the element (N+1) are put into place;

the sections of webs of the element (N+1) are put into place;

the shuttering and reinforcement for the upper slab of the element (N+1) are put into place;

the connecting of the sections of webs of the element (N) to those of the element (N–1) is completed;

the concrete of the lower and upper slabs of the element (N+1) is cast;

the lower and upper slabs of the element (N+1) are respectively connected to the corresponding slabs of the element (N).

This method is illustrated by FIGS. 6 to 9 which relate to a bridge girder constructed by means of successive structural elements (N–1), (N), (N+1) fabricated in situ so as to overhang, that is to say in a cantilevered fashion, by means of a portal frame of any known type which can move and bear on the parts already constructed and which it is unnecessary to describe here.

Figure 6:
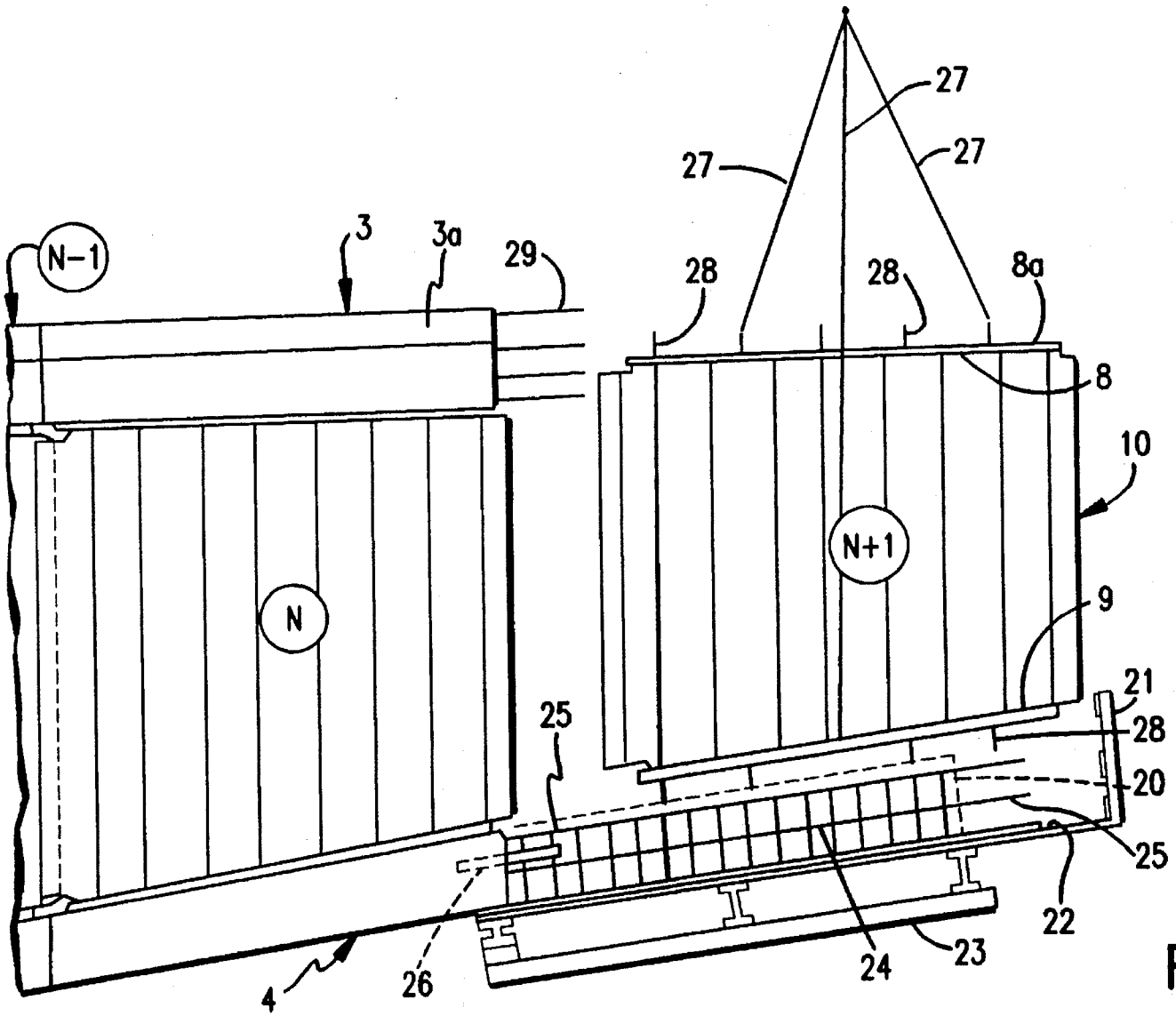
FIGS. 6 and 7 are two diagrammatic views illustrating two phases of employing a novel metal girder element in accordance with the invention.

The situation depicted in FIG. 6 is as follows. The sections of upper 3 and lower 4 slabs of the structural element (N) have been cast, have set and are connected to those of the element (N–1). The sections of web 10 of the element (N) are in the process of being welded to the sections of web 10 of the element (N–1). The work of preparing the element (N+1) has started.

The lateral shuttering 20, the transverse shuttering 21 and the shuttering 22 for the bottom of the section of lower slab of the element (N+1) are in place and supported by the framework 23 carried by the aforementioned portal frame (not depicted). The reinforcements 24 of this section of slab are also in place and are connected to the reinforcing bars 25 left as starter bars, projecting with respect to the section of lower slab 4 of the element (N). A supporting beam 26, one end of which is embedded in the slab of the element N, also projects in the midst of the reinforcements 24.

The metal girder element 6 of the structural element (N+1) is brought closer by means of a lifting machine (not depicted) and by slings 27. The section of web 10 is, in this example, a corrugated metal sheet connected to the sections of upper 8 and lower 9 flange. The latter carry, on their outer face, connection elements 28 of any type.

Starter bars 29 also project from the section of upper hollow block 3 of the element (N).

Figure 7:
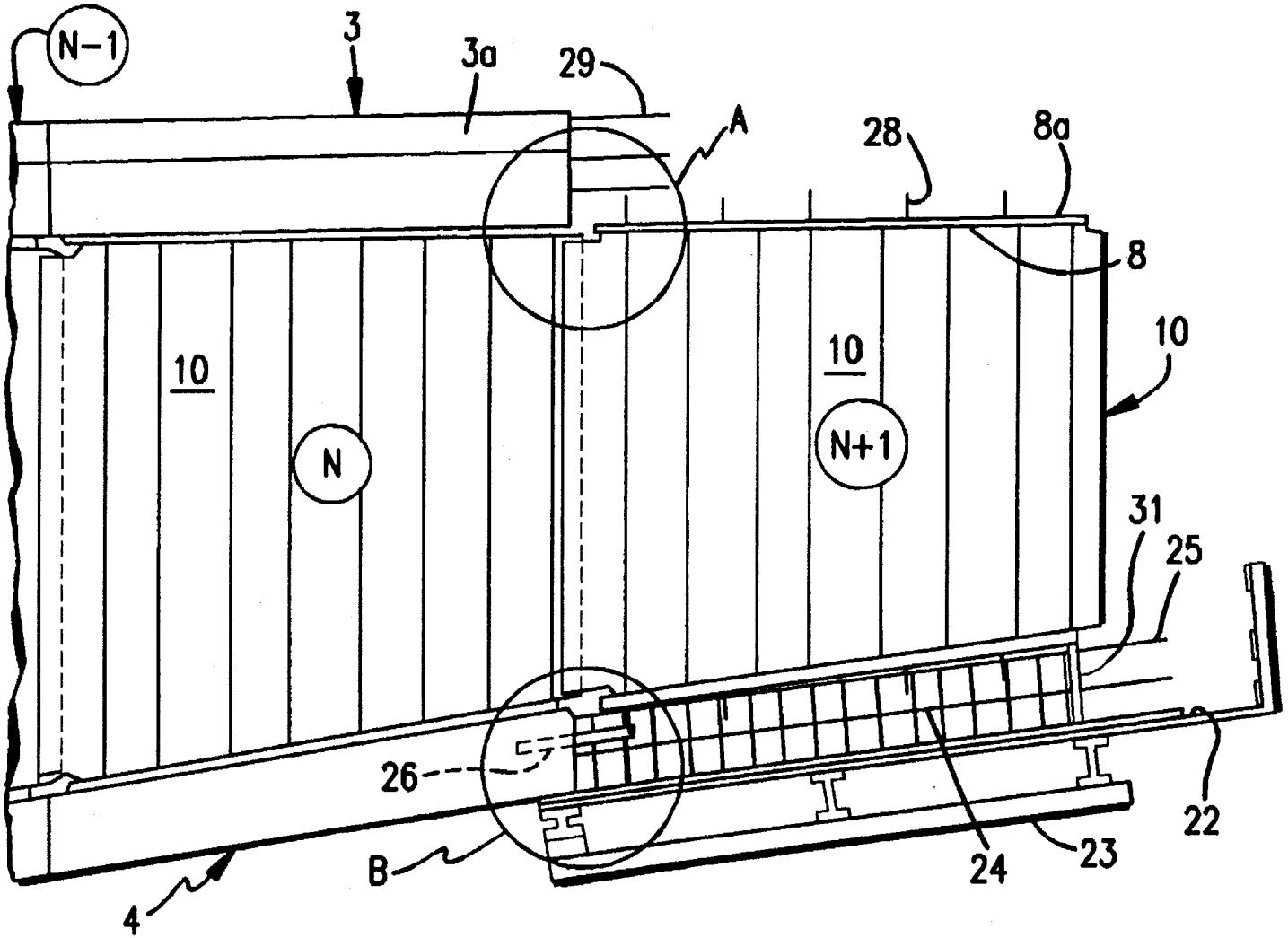

In FIG. 7, the metal girder element 6 of the structural element (N+1) is in place.

Figure 9:
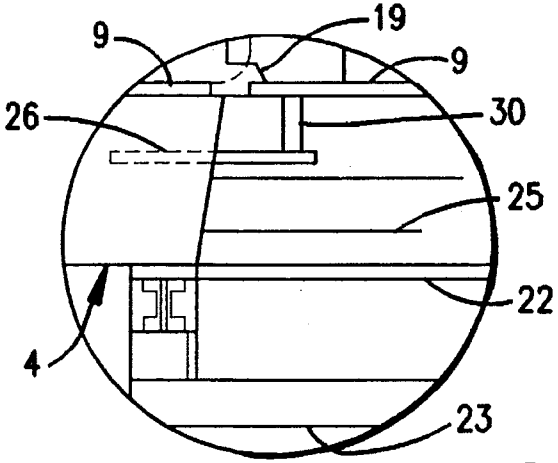
FIG. 9 is an enlarged view of the detail B in FIG. 7.

As may be seen in FIG. 9, a second beam element 30 rests on the beam 26 for the positional adjustment of the section of lower flange 9. At the other end of this section 9, a jack 31 enables the level of this flange to be adjusted.

Figure 8:
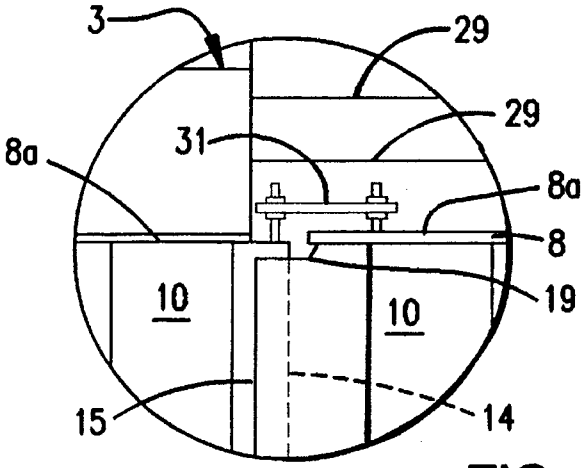
FIG. 8 is an enlarged view of the detail A in FIG. 7.

As may be seen in FIG. 8, a system for adjustment with a threaded rod 32 enables the upper part of the metal girder element to be adjusted.

Once this adjusted element is in position, all that is required to be done is to put the shuttering elements and the reinforcements necessary for the section of upper hollow block in place.

The welding of the sections of webs 10 of the element (N) to those of the element (N–1) will have to be completed before casting the concrete of the sections of slabs 3, 4 of the element (N+1).

In the case where the elements of the hybrid elongate structure are suitable for being connected to each other by means of prestressing tension members, prestressing tension members are provided which connect respectively the upper and lower slabs of the structural element (N) to those of the structural element (N–1) and these prestressing tension members are tensioned before starting to connect the sections of webs of the element (N) to those of the element (N–1), while still starting to prepare the element (N+1).

A metal girder element and a method of employing this element have thus been described which make it possible to construct a hybrid elongate structure of box-type cross section under excellent cost and construction-site duration conditions.

In particular, it is thus possible to construct a hybrid elongate structure prestressed with corrugated-sheet-metal webs, by constructing and joining, in situ, to each other, overhanging structural elements. Such a hybrid structure thus has all the advantages described in EP-A-0,283,383, while at the same time having all the advantages of an overhanging construction, with the possibility of carrying out all the operations of joining the webs of an element, for example by welding, in what would otherwise be lost time during the operations of preparing the concrete parts of the next element.

Of course, the invention is not limited to the embodiments which have just been described, and it is possible to make numerous changes and modifications to them without departing from the scope of the invention.

I claim:

1. A hybrid elongate structure of box-type cross section including a concrete upper slab and a concrete lower slab connected to each other over their entire length by two continuous series of metal girders, each said series of girders and each slab forming a side of said box-type cross section with said two series of girders spaced apart horizontally from each other and said slabs spaced apart vertically from each other, each said girder of each said series of girders comprising a web and two spaced flanges on opposite edges of the web, each said flange having on its surface opposite the web projecting members embedded in the concrete of a respective one of said slabs, said webs of adjacent said girders in each said series being secured to each other, each said flange being shorter than its associated said web in a direction lengthwise of said flanges and having ends which are spaced from ends of said flanges of adjacent said girders.

2. A structure as claimed in claim 1, wherein each said web is a flat metal sheet.

3. A structure as claimed in claim 1, wherein each said web is a corrugated metal sheet.

4. A method to construct a hybrid elongate structure of box-type cross section as claimed in claim 1, comprising connecting to each other sections of said concrete upper slab and sections of said concrete lower slab, and thereafter connecting to each other said webs of each said series of webs.

5. A method to construct a hybrid elongate structure of box-type cross section as claimed in claim 1, comprising casting said upper and lower concrete slabs in sections, each section being secured to a corresponding said web, there being a said section cast onto an upper said flange and a said section cast onto a lower said flange of each said web, connecting said upper and lower sections on a said web to corresponding upper and lower said sections on an adjacent said web, and thereafter interconnecting directly to each other the two webs thus juxtaposed.

* * * * *